United States Patent [19]

Zafuto

[11] 3,995,320

[45] Dec. 7, 1976

[54] PROTECTIVE JACKET

[76] Inventor: Samuel L. Zafuto, 436 75th St., Niagara Falls, N.Y. 14304

[22] Filed: July 18, 1975

[21] Appl. No.: 597,071

[52] U.S. Cl. ..... 2/2

[51] Int. Cl.[2] ..... A41D 13/00

[58] Field of Search ..... 2/2, 16, 22, 24

[56] References Cited

UNITED STATES PATENTS

| | | | |
|---|---|---|---|
| 876,237 | 1/1908 | Ridlon | 2/2 |
| 1,726,939 | 9/1929 | Anderson | 2/2 X |
| 2,247,961 | 7/1941 | Mulvey | 2/2 |
| 3,008,214 | 11/1961 | Foster et al. | 2/2 X |

*Primary Examiner*—Werner H. Schroeder
*Assistant Examiner*—Peter Nerbun
*Attorney, Agent, or Firm*—Bauer, Amer & King

[57] ABSTRACT

An inflatable jacket having a network of internal pressure air compartments which cooperatively communicate with each other through constricted airflow passageways, so that air displacement from one selected compartment is resisted by the pressure of the adjacent and other compartments; whereby said jacket, when used for example for karate, can cushion an external blow of significant force with pressure air of a nominal amount, e.g. 9 lbs. per square inch which can easily be supplied by a simple pump.

2 Claims, 6 Drawing Figures

PROTECTIVE JACKET

The present invention relates generally to an improved chest covering for use during sports activities, one primary end use being to prevent injury from a karate blow which could possibly be delivered with a force of 1500 lbs. per square inch, wherein the improvements more particularly provide a protective jacket which can effectively cushion a heavy blow or force, and which jacket nevertheless is characterized by a simple, economically manufactured construction and requires, for inflation, only nominal air pressure.

As generally understood, there are many models and types of inflatable jackets or chest protectors which are intended to prevent chest injury by appropriately cushioning a blow or force delivered thereagainst. The pressure air used to inflate the jacket is required to prevent actual contact with the wearer's chest, and thus typically is of sufficient pressure to achieve this objective, even though this in turn requires use of a compressor or motorized pump. Alternatively, as exemplified by U.S. Pat. No. 3,550,159, the prior art jacket construction contemplates a number of pressure air compartments in superposed relation with each other, so that in order to penetrate to the wearer's chest, the blow must cause air displacement from these aligned compartments positioned the path of the blow. While effective, superposed or aligned pressure air compartments significantly add to the cost of construction of the protective jacket, as well as to its weight and bulk.

Broadly, it is an object of the present invention to provide an improved protective jacket, for karate or use in other sports or similar activities, which overcomes the foregoing and other shortcomings of the prior art. Specifically, it is an object to provide a karate jacket which can assist in withstanding a force which is possibly 1500 lbs. per square inch, and yet is inflated by a simple pump in that it requires pressure air which does not significantly exceeds 9 lbs. per square inch.

A protective jacket for use in karate or a similar impact-absorbing situation which demonstrates objects and advantages of the present invention includes a rear and a front plastic panel arranged in facing relation to each other, each panel being of a size coextensive with the wearer's chest area. A peripheral heat seal joins the panels to each other so as to define therebetween a pressure air compartment to provide an absorbing function in relation to a blow applied against the jacket. Specifically, a body of pressure air, approximately 9 lbs. per square inch is confined within the compartment so as to hold the front and rear panels in separated clearance positions from each other, the confinement being within smaller compartments formed by an operative arrangement of a plurality of heat seals joining said front and rear panels to each other in which each said heat seal is of a selected length and spaced from an adjacent heat seal so as to define a constricted airflow passageway therebetween in the spacings between adjacent heat seals. Thus, the foregoing arrangement of heat seals delineates the pressure air compartment into said smaller compartments, all of which communicate with each other through a plurality of said constricted airflow passageways, whereby a blow applied against a selected smaller compartment causes an optimum minimum displacement of pressure air therefrom due to the constriced airflow through said plural passageways to thereby result in effective cushioning of said blow.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein: FIG. 1 is a perspective view illustrating one end use of the within jacket for karate;

Figure 1:
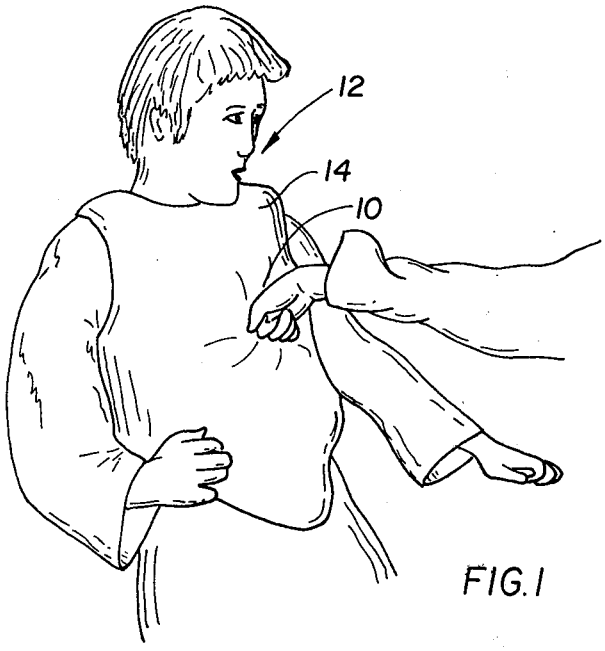
Figure 3:
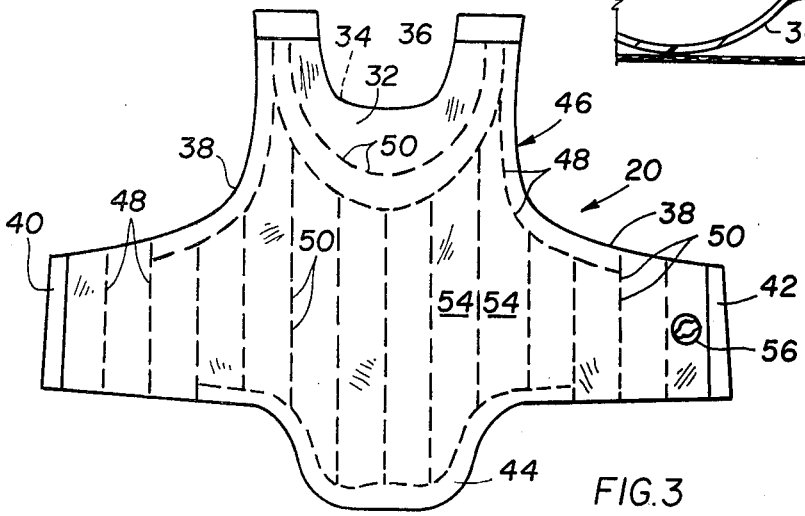
FIG. 3 is a plan view of the jacket hereof, constructed of plastic, illustrating the operative arrangement of heat seals forming a part of said jacket.

Reference is now made to the drawings, and initially to FIGS. 1 and 3 thereof. One primary intended end use for the jacket thereof is for protection during a karate excercise or contest, during which a blow typically of as much as 1500 lbs. per square inch might be delivered, as at 10, on a localized target within the chest area of a karate player 12. To prevent serious injury from blow 10, the karate player 12 is outfitted under the cloth covering 14 with a protective jacket, generally designated 20, having the construction, as will now be described in detail, which effectively cushions the 1500 lbs. per square inch blow delivered at the localized area 10. Moreover, as described herein, while jacket 10 is formed with internal pressure air compartments, pressure air confined therein is not significantly more than 9 lbs. per square inch, and yet it prevents penetration of the 1500 lbs. per square inch blow 10 against the wearer's chest.

Figure 2:
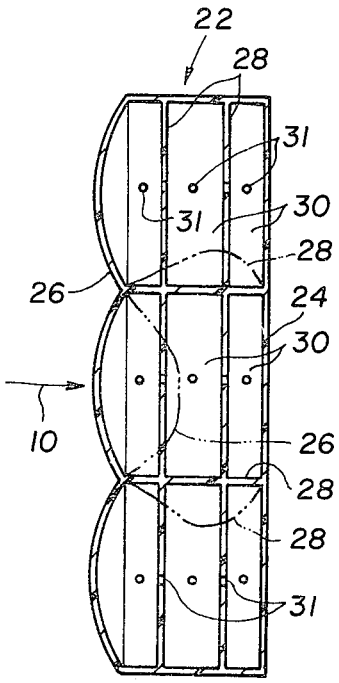
FIG. 2 PRIOR ART
FIG. 2 is a partial side elevational view of a typical prior art construction for a jacket illustrating the manner in which it absorbs a karate blow.

Before describing the jacket 20, it is useful to refer to a typical prior art jacket construction illustrated in FIG. 2 and exemplified by prior U. S. Pat. No. 3,550,159. As illustrated in FIG. 2, the construction of the jacket, generally designated 22 and illustrated in cross section, includes a rear panel 24, a front panel 26, and a network of horizontally and vertically oriented panels, individually and collectively designated 28, which subdivide the volume between the panels 24 and 26 into plural pressure air compartments, again individually and collectively designated 30. To permit entry of the pressure air into compartments 30, there is typically a single air passageway in the walls which bound the compartments 30 through which passageways all of the compartments 30 communicate with each other.

Assuming prior art jacket 22 occupies a covering position over the chest area of the karate player 12, then the karate blow 10 delivered against the front panel 26 of the jacket, results, as illustrated in phantom perspective in FIG. 2, in significant inward movement of panel 26 in the area which constitutes the target area of the blow 10. This significant penetration within the volume of the jacket 22 must of necessity occur since the horizontally oriented wall 28 will bulge outwardly, again as illustrated in phantom perspective in FIG. 2, in response to the delivery of the karate blow 10. Penetration to an extent within the internal volume of the jacket 22 which actually brings the front panel 26 against the rear panel 24 and thus permits the application of the force directly against the wearer's chest, is only prevented because of the plurality of chambers 30 which are interposed between the front panel 26 and the rear panel 24. However, the internal construction which provides the multiple compartments 30 in superposed relation between the rear and front panels 24 and 26 in obvious manner significantly adds to the cost of construction, the weight, and the bulk of the prior art jacket 22.

Obviating the foregoing and other shortcomings of the prior art, the protective jacket 20 hereof is of greatly simplified construction and yet effectively cushions, as already indicated, the force of a karate blow which could typically be as much as 1500 lbs. per square inch. To this end, jacket 20 consists simply of a single front and rear plastic panel 32 and 34, respectively (see in particular FIG. 5A for rear panel 34) which each have an identical peripheral shape which suits these panels, when joined together, to fit in wrapped relation about the chest area of the karate player 12. Specifically, the panels 32, 34 include a neck cutouts 36, 36 left and right arm encircling edges 38 and 40, waist-encircling flaps 40 and 42, and finally a depending front section 44. Specifically, each panel 32 and 34, is preferably plastic, and is die cut to include the structural features just enumerated, after which the panels are placed in superposed relation to each other and are joined by a peripheral heat seal, generally designated 46 (which heat seal although shown applied along the edge 38 in FIG. 3, will be understood to extend fully along the entire peripheral outline of the jacket 20). As a result of the heat seal 46 joining the plastic panels 32 and 34, it is possible to introduce pressure air internally between the panels to provide the cushioning or absorbing function in relation to the karate blow 10 previously noted.

However, a single pressure air compartment between the plastic panels 32 and 34, unless filled with pressure air equalizing the 1500 lbs. per square inch of the karate blow, will not adequately counteract the force involved as is necessary to prevent chest injury to the wearer 12. In conjunction with the peripheral heat seal 46, therefore, the jacket 20 includes an operative arrangement, as illustrated in FIG. 3, of a plurality of lengths of heat seals, individually and collectively designated 48, which, where they are applied, as illustrated in FIG. 5A, result in fusing of the plastic of the front and rear panels 32 and 34 together. In the spacings, however, between adjacent heat seals 48, individually and collectively designated 50, the plastic panels 32 and 34 are, of course, not joined together, and consequently, again as shown in FIG. 5A, constricted airflow passageways 52 exist between the heat seals 48. Still referring to FIG. 3, it will be noted that the heat seals 48, at least in the medial area of the jacket 20, are oriented vertically so as to subdivide or delineate the internal pressure air compartment between the panels 32 and 34 into smaller compartments, individually and collectively designated 54 (only two of which compartments, for simplicity sake, being shown in FIG. 3). In addition to the vertically oriented rows of heat seals 48, there are also curved rows which follow the contour of the neck cut-out 36 and arm cut-outs 38 and 40. Completing the construction of the jacket 20 is a valve means 56 appropriately heat sealed in position within the front panel 32 through which pressure air can be admitted into the network of internal pressure air compartments 54.

Figure 5B:
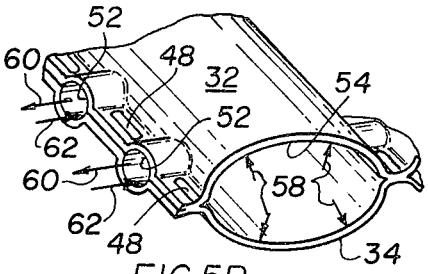
FIGS. 5A and 5B are respectively a side elevational view taken along line 5—5 of FIG. 4 and a perspective view, both illustrating details of the constricted airflow passageways in communication with the pressure air compartments of said jacket.
Figure 5A:
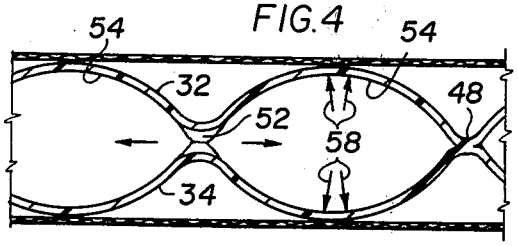

The manner in which the jacket 20 hereof, having the construction just described, effectively cushions a heavy, localized external force 10 applied against it, is best illustrated in FIGS. 5A and 5B, to which attention is now directed. Pressure air, which does not have to significantly exceed 9 lbs. per square inch, is admitted initially through the valve means 56 and fills the subdivided internal pressure air compartments 54. In this connection, pressure air naturally fills the compartment 54 nearest the valve means 56, and then each compartment 54 is successively filled until the entire jacket 20 is inflated. During this time, the air flow passageways 52, through which are all of the compartments 54 communicate, serves the useful function of permitting the successive inflation of the compartments 54. After the jacket is fully inflated, the valve means 56 is closed with an appropriate plug or the like, and said jacket is then placed in covering relation over the chest area of the individual 12. Naturally, the neck cut-out 36 is placed under the chin, and the armhole — defining edges 38 and 40 under the right and left arms of the individual. As a consequence, the flaps 40 and 42 assume a wrapped relation about the waist of the individual 12 while the depending flap 44 extends over his abdomen. Facilitating the wrapping of the jacket 12 is the fact that the heat seals 48 are vertically oriented in the medial and in the flap areas of said jacket.

Figure 4:
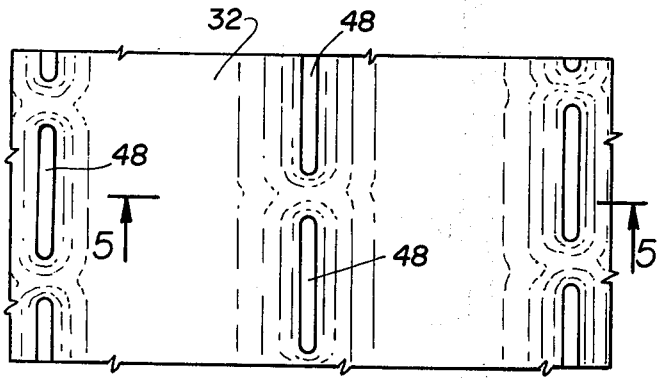
FIG. 4 is a partial plan view, on an enlarged scale, illustrating details of said heat seal.

With the inflated jacket 20 in position, it is then preferred to hold it in place using a fabric covering 14 having suitable neck and waist ties (not shown) which are appropriately joined behind the neck and waist of the individual. If it is next assumed that a karate blow 10 is delivered as illustrated in FIG. 1, this will of course result in the application of what might typically be 1500 lbs. per square inch against the front panel 32. Since there are no horizontally oriented internal walls, similar to the walls 28 of the prior art construction of FIG. 2, the force applied against panel 32 will have a tendency of causing displacement of the pressure air, represented by the reference arrows 58 in FIGS. 5A, 5B, from out of the pressure air compartment 54 against which blow 10 is actually applied. This tendency of air displacement applied against a single airflow passageway 52 could cause a rupture of the plastic bounding such single passageway. However, since each compartment 54 has a large number of airflow passageways 52 in communication with it, said number as illustrated in FIG. 3 being typically in excess of 20, the displacing air fans out circumferentially from the target area 10 and moves toward all of these airflow passageways 52. Then, in each instance, the flowing air moves in constricted or significantly slowed fashion through a cooperating airflow passageway 52 because of the comparatively small demension of each. Moreover, because the heat seals 48 are formed as discrete lengths, as best illustrated in FIG. 4, it has been found in practice that this prevents rupturing of the plastic in the critical areas about the airflow passageways 52. Stated another way, the airflow out of the affected compartment 54, illustrated by the reference arrow 60 in FIG. 5B, is resisted by the opposing air pressure 62 in an adjacent pressure air compartment 54, all to the end of causing an optimum minimum displacement of pressure air flow from said affected compartment 54. As a result, with respect to said compartment 54 against which the blow 10 is actually delivered, the front panel 32 is maintained in its separated clearance position from the rear panel 34 and there is therefore no penetration significantly through the inflated volume of the jacket 20 which could conceivably result in actual contact of a fist or other implement delivering the blow against the chest of the individual 12 which could result in chest injury.

From the foregoing it should be readily appreciated that jacket 20 formed of a series of spaced heat seals 48 which delineate comparatively small pockets or pressure air compartments which communicate with each other through a network of numerous constricted airflow passageways 52 constitutes a relatively simple construction which is easy to apply, using a heat sealing method, to the superposed front and rear panels 32, 34, and yet this construction, using only approximately 9 lbs. per square inch of pressure air, can effectively cushion a blow or impact of significantly greater force. In a preferred embodiment, each heat seal 48 is approximately one inch and the spacings 50 between adjacent heat seals is approximately one quarter of an inch; also, the width of the vertically oriented compartments 54 in the medial portion of the jacket 20 is approximately 2½ inches. While these dimensions are preferred, it will be understood that a latitude of modification, change and substitution is intended in these dimensions, as well as in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A protective jacket for use during sports activities of the type having an operative position in covering relation to the wearer's chest area for absorbing the impact of a blow that may be applied thereagainst within said chest area of a possible force of 1500 lbs per square inch, said jacket comprising a rear and a front plastic panel arranged in facing relation to each other, each panel being of a size coextensive with said chest area, a peripheral heat seal joining said panels to each other so as to define therebetween a pressure air compartment to provide said absorbing function in relation to said applied blow, a body of pressure air of approximately 9 lbs. per square inch confined within said compartment so as to hold said front and rear panels in separated clearance positions from each other, and an operative arrangement of a plurality of vertically oriented adjacently positioned heat seals joining said front and rear panels to each other in which each said heat seal is of a selected length of one inch and spaced from an adjacent heat seal one-quarter inch so as to define a constricted airflow passageway therebetween in said spacings between said adjacent heat seals, substantially all of the heat seals other than the peripheral heat seal being formed along lines that extend in a single direction with adjacent heat seals extending along the same line said arrangement of such heat seals delineating said pressure air compartment into smaller compartments communicating with each other through a plurality of said constricted airflow passageways, whereby a blow applied against a selected smaller compartment causes an optimum minimum displacement of pressure air therefrom due to the constricted airflow through said plural passageways to thereby result in effective cushioning of said blow.

2. A protective jacket as defined in claim 1 including an outer fabric chest area covering with means for securing the same about said wearer's neck and waist in covering relation over said jacket, to thereby hold said jacket in place.

* * * * *